US006515596B2

(12) United States Patent
Awada

(10) Patent No.: US 6,515,596 B2
(45) Date of Patent: Feb. 4, 2003

(54) SPEED LIMIT DISPLAY IN A VEHICLE

(75) Inventor: Faisal M. Awada, Round Rock, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/801,606

(22) Filed: Mar. 8, 2001

(65) Prior Publication Data

US 2002/0126023 A1 Sep. 12, 2002

(51) Int. Cl.[7] ..... G08G 1/09
(52) U.S. Cl. ..... 340/905; 340/901; 701/202
(58) Field of Search ..... 340/905, 988, 340/901, 902; 381/86; 701/117, 119, 202

(56) References Cited

U.S. PATENT DOCUMENTS 3,668,624 A 6/1972 Spaulding ..... 340/32
4,314,232 A 2/1982 Tsunoda ..... 340/52 F
5,485,161 A * 1/1996 Vaughn ..... 342/357.13
5,523,765 A 6/1996 Ichikawa ..... 342/451
5,819,198 A 10/1998 Peretz ..... 701/117
5,844,505 A * 12/1998 Ryzin ..... 340/988
6,072,387 A * 6/2000 Overbeck et al. ..... 340/438
6,161,072 A * 12/2000 Clapper ..... 701/93
6,169,894 B1 * 1/2001 McCormick et al. ..... 455/414
6,253,146 B1 * 6/2001 Hanson et al. ..... 701/202
6,265,989 B1 * 7/2001 Taylor ..... 340/901
6,278,935 B1 * 8/2001 Kaplan et al. ..... 701/200
6,278,939 B1 * 8/2001 Robare et al. ..... 701/208

* cited by examiner

*Primary Examiner*—John Tweel
(74) *Attorney, Agent, or Firm*—Duke W. Yee; Volel Emile; Michael R. Nichols

(57) ABSTRACT

A method and apparatus for reporting a posted speed limit to the driver of a vehicle is disclosed. The position of the vehicle is determined using a GPS receiver or triangulation of cellular telephone signals. The position is used to retrieve speed limit or other information from a database. The information is then reported to the driver. A technique is also disclosed for comparing the actual speed of the vehicle with the posted speed limit and issuing a warning to the driver when the posted speed limit is exceeded.

15 Claims, 4 Drawing Sheets

SPEED LIMIT DISPLAY IN A VEHICLE

BACKGROUND OF THE INVENTION

1. Technical Field

The present invention is directed generally toward a method and apparatus for reporting a posted speed limit or other traffic information to the operator of a vehicle. More specifically, the present invention is directed toward a system for determining the position of a vehicle and reporting speed limit information based on the determined position.

2. Description of Related Art

When driving a vehicle, it often happens that one forgets what the posted speed limit is on the stretch of road one is driving on. In some circumstances, a driver is unable to observe the posted speed limit because the speed limit sign is obstructed from the driver's view. In such cases, it would be helpful if the driver were provided with a constant indication of the posted speed limit, as a display on the dashboard of an automobile, for instance.

A number of solutions to this problem have been posed in the past. For instance, U.S. Pat. No. 5,819,198 describes a system in which speed limit signs emit radio signals to indicate the speed limit, and U.S. Pat. No. 3,668,624 describes a system in which speed limit information is encoded through magnets embedded in the road. One of ordinary skill in the art will appreciate that these proposed solutions require costly modifications to existing roads and highways.

What is needed is a system for reporting speed limit information in a vehicle that works with the existing transportation infrastructure in a cost-effective way.

SUMMARY OF THE INVENTION

Accordingly, the present invention provides a method and apparatus for reporting a posted speed limit to a vehicle driver.

In one embodiment of the invention, a Global Positioning System (GPS) receiver associated with the vehicle determines the position of the vehicle and uses that position as a search key in a locally-stored database to retrieve speed limit information. The retrieved speed limit information is then reported to the driver. In an alternative embodiment of the invention, the database is located in a remote location with respect to the vehicle, and database access is performed through a wireless communication link. In another embodiment of the invention, the position and speed of the vehicle are determined by triangulating cellular telephone transmissions. In yet another embodiment of the invention, a warning display is activated if the vehicle exceeds the posted speed limit. In still another embodiment of the invention, a warning chime is played through a speaker or through the earpiece of the driver's cellular telephone, if the vehicle exceeds the posted speed limit.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENTS

Figure 1:
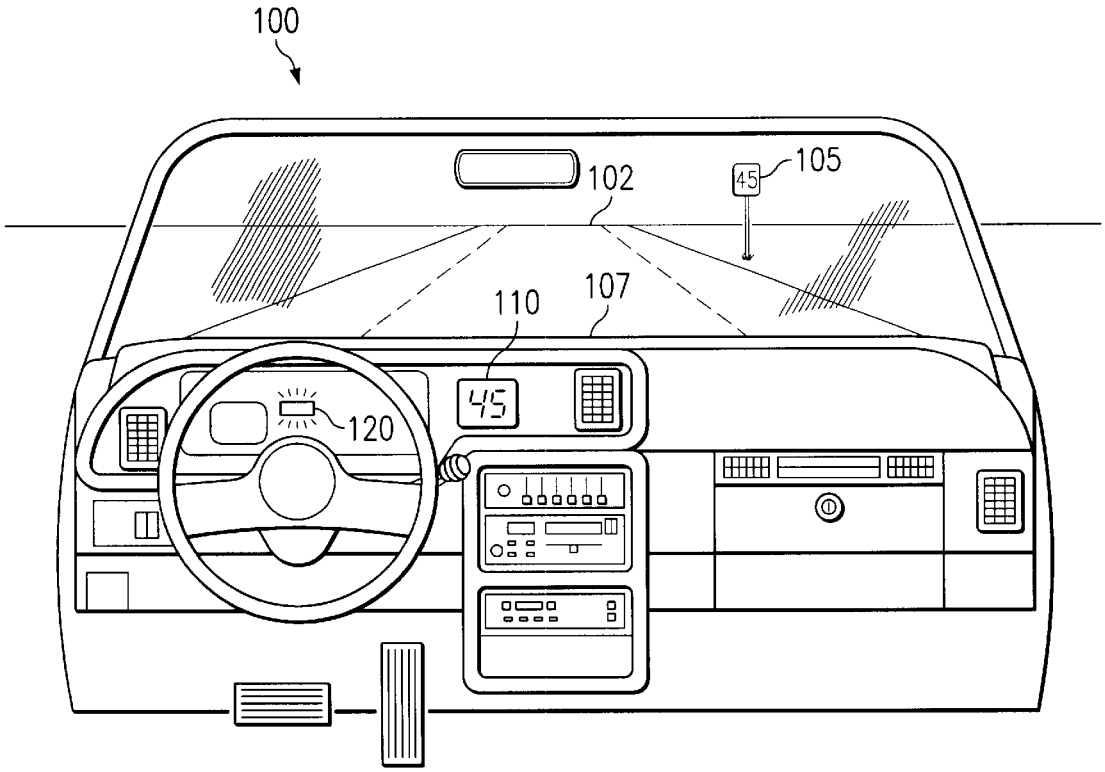
FIG. 1 is an interior view of a vehicle in accordance with a preferred embodiment of the invention.

FIG. 1 depicts the interior 100 of a motor vehicle in accordance with a preferred embodiment of the present invention. The vehicle is traveling on a road 102 having a posted speed limit 105. On the dashboard 107 of the vehicle is mounted a numerical display 110 showing the posted speed limit corresponding to the portion of road the vehicle is traveling along. In addition, a warning light 120 indicates when the vehicle's speed exceeds the posted speed limit.

The present invention provides mechanisms by which the posted speed limit for a portion of roadway is identified and displayed on the display 110. As will be described in further detail hereafter, the present invention may obtain speed limit information using GPS location determination equipment, cellular radio transmission triangulation, or the like. The geographic location is used to retrieve, from a database, speed limit information associated with that location. The speed limit information retrieved can then be displayed on the display 110. A comparison of the speed limit information with the vehicle's actual rate of speed can be made so as to activate the warning light 120 or other warning mechanism when the vehicle exceeds the speed limit by a predetermined amount (for instance, when the vehicle speed exceeds the speed limit by seven miles per hour).

One of ordinary skill in the art will recognize that the display 110 need not be a dashboard-mounted light-emitting diode (LED) display as depicted in FIG. 1. Many different forms of display may be used, including (but not limited to) liquid crystal display (LCD), cathode-ray tube display, flat-panel display, analog gauge display, and heads-up display. Alternatively, an audio recitation of the posted speed limit may be used. When such an audio recitation is used, the processor may be programmed to play an audio recitation of the speed limit whenever the driver exceeds the speed by a sufficient amount.

Figure 2A:
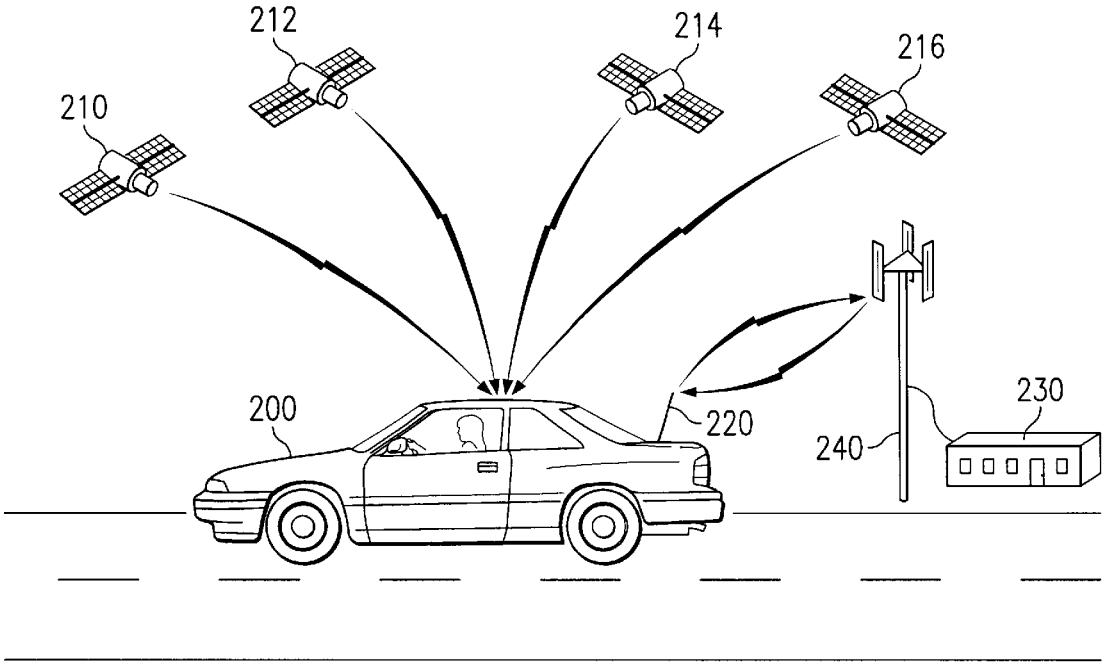
FIG. 2A is a diagram depicting the operation of a preferred embodiment of the invention.

FIG. 2A depicts the operation of a preferred embodiment of the present invention. A vehicle 200 is equipped with a Global Positioning System (GPS) receiver (not shown). The Global Positioning System, developed for the U.S. Department of Defense, allows anyone with a GPS receiver to identify his or her location on the earth's surface with a high degree of accuracy.

The GPS receiver receives signals from a number of GPS satellites 210, 212, 214, 216 in non-geosynchronous orbit around the earth. A minimum of three satellites' signals must be received for the GPS receiver to determine a geographical location. At least four satellites are necessary to determine elevation as well. Fortunately, sufficient GPS satellites orbit the earth such that at any given time at any given location on the earth's surface, there are more than the requisite number of satellites within reception range.

From reading the signals of the GPS satellites 210, 212, 214, 216, the GPS receiver determines the geographical location of the vehicle. This location is then used as a search key to retrieve a numerical speed limit from a database. The database may be located within the vehicle 200 and stored in a memory or on a storage device such as a CD-ROM, which may be periodically updated by the vehicle's operator or owner.

Alternatively, the database may be stored in a remote location 230, in which case the vehicle 200 requests speed limit information from the remote location 230 by transmitting a request through an antenna 220 mounted to the vehicle. The remote location 230 receives the request through its own antenna 240 and responds with the proper speed limit information.

In yet another embodiment, the database may be located in the vehicle 200, but periodically updated by a remote location 230 transmitting an update signal through a broadcast antenna 240. The vehicle 200 receives the update signal through its antenna 220 and updates its database based on the update signal.

In any of the above embodiments, the speed limit information from the speed limit database is provided to a processor (not shown) within the vehicle. The processor receives the speed limit information and instructs a display within the interior of the vehicle to display the speed limit for the roadway on which the vehicle is traveling.

Figure 2B:
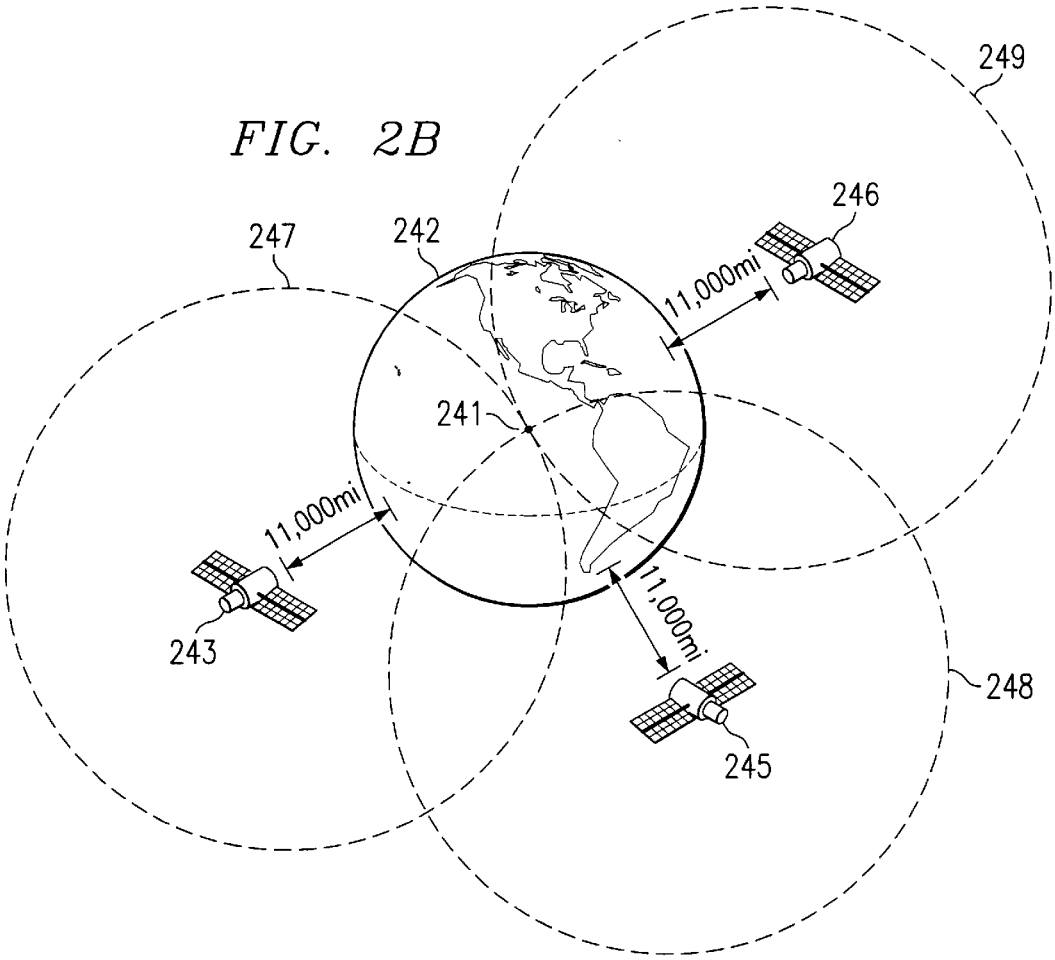
FIG. 2B is a diagram depicting a process of determining a vehicle's location utilizing GPS technology in accordance with a preferred embodiment of the invention.

FIG. 2B depicts how the process of determining the position 241 of a vehicle on the earth 242 using the GPS receiver can be performed. GPS satellites 243, 245, 246 each contain an atomic clock and emit timing signals that are precisely synchronized. The GPS receiver at the vehicle's location 241 is also synchronized with the satellites 243, 245, 246. Thus, when the GPS receiver receives the signals from the satellites 243, 245, 246, it notes how long it took for the signals to reach the receiver. By determining the time it took for the signal to reach the receiver, the GPS receiver determines the distance to each of the satellites 243, 245, 246 from the receiver's location 241. Those distances are graphically represented in FIG. 2B by spheres 247, 248, 249.

An electronic almanac is stored within the GPS receiver, which allows the receiver to know the exact locations of the satellites 243, 245, 246 at any given time. Knowing the locations of three satellites 243, 245, 246, their distances from the receiver 241, and that the satellites 243, 245, 246 orbit the earth 242 at a vertical distance of 11,000 miles, allows the receiver to calculate its latitude and longitude on the earth, which is a position within the intersection of the three spheres 247, 248, 249. If four satellites are available, the altitude of the receiver can be calculated as well.

Figure 2C:
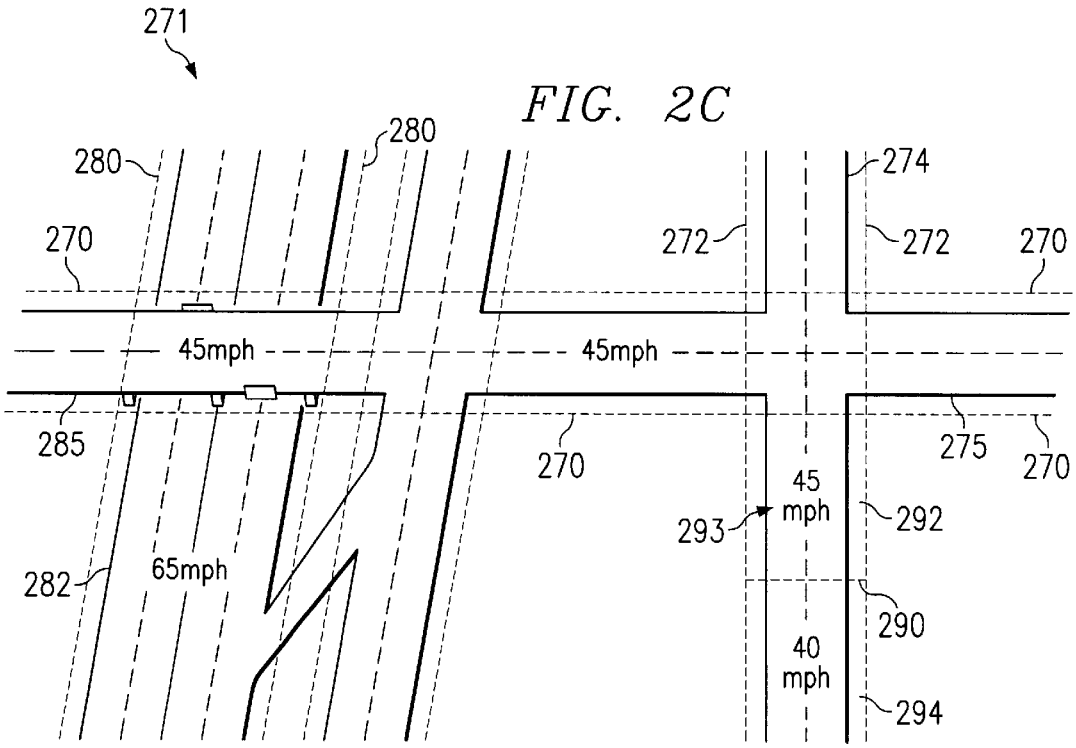
FIG. 2C is a map containing several streets and depicting how a geographic area can be divided into speed zones.

FIG. 2C demonstrates how positional data derived from the GPS receiver can be used to obtain a speed limit. FIG. 2C is a map of a typical set of roads and intersections in a city. Zones 270, 272, 280 are defined around roads 275, 274, 282 at ranges of latitudes and longitudes. When a vehicle is located within a zone 292 (when the latitude and longitude of the vehicle fall within the ranges specified for the zone), the speed limit associated with that zone 293 is the posted speed limit.

Two zones may be joined end-to-end along the same road. This allows for a change in speed limit on the same road. For example, in FIG. 2C, a car traveling through zone 294 would have a speed limit of 40 miles per hour, but after crossing the boundary 290 into the adjoining zone, the vehicle has a speed limit of 45 miles per hour.

Also, which zone a vehicle is in may depend on either the altitude of the vehicle or the direction the vehicle is traveling in. For instance, in FIG. 2C, an overpass 285 extends over a controlled-access highway 282. If a vehicle is traveling on the overpass 285, which is at a higher elevation and extends in a different direction than the controlled-access highway 282, the zone and speed limit are different than would be the case if the vehicle were traveling on the controlled-access highway 282.

Figure 2D:
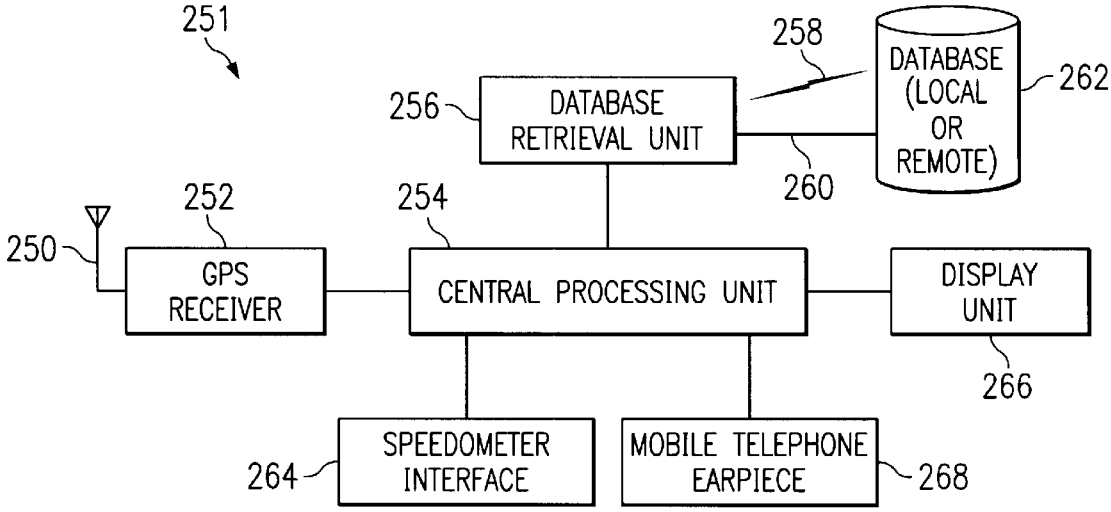
FIG. 2D is a block diagram of a GPS-based embodiment of the invention.

FIG. 2D provides a block diagram 251 of a preferred embodiment of the invention. An antenna 250 is connected to a GPS receiver 252, which determines the position of a vehicle based upon signals from GPS satellites received through the antenna 250. The position information calculated by the GPS receiver 252 is sent to a central processing unit (CPU) 254.

The CPU 254 makes use of a database retrieval unit 256 to retrieve from a database 262 speed limit information based on the calculated position of the vehicle. The database 262 may be located in the vehicle, in which case the database retrieval unit 260 is simply connected to database storage 262. Alternatively, the database 262 may be at a remote location, so a communication link 258 (through radio, for instance) is established with the remote database 262. The speed limit information obtained by the database retrieval unit 256 is reported back to the CPU 254.

Optionally, information about the vehicle's current speed may be obtained through a speedometer interface 264 and reported to the CPU 254. Finally, the proper speed limit, and possibly a warning signal to indicate an exceeded speed limit are displayed through a display unit 266 based on instructions from the CPU. CPU 254 may also direct the user's cellular or other mobile telephone to play a warning sound through the earpiece of the user's mobile telephone (268).

Figure 3:
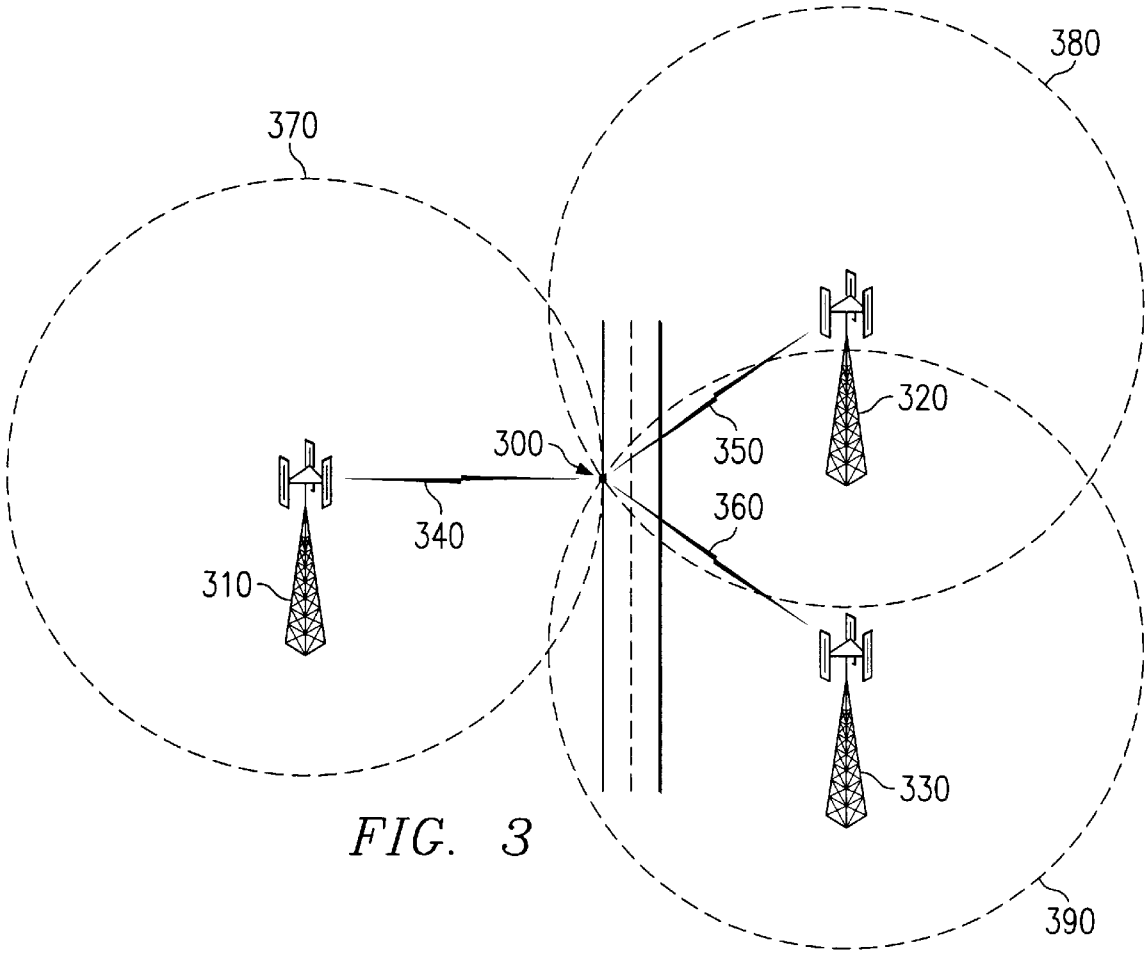
FIG. 3 is a diagram depicting the process of determining the position of a vehicle using cellular telephone transmissions.

FIG. 3 demonstrates the operation of an alternative embodiment of the invention utilizing the triangulation of cellular or other mobile telephone signals to determine the location of the vehicle. As the vehicle 300 travels, a cellular telephone in the possession of the driver of the vehicle is in communication with three cellular telephone antenna stations 310, 320, 330. The three stations 310, 320, 330 and the cellular telephone are synchronized precisely as were the GPS satellites and receiver in the previous embodiment.

When the cellular telephone in the vehicle 300 emits a signal, the three antenna stations 310, 320, 330 receive the signal at different times. This is because the distances 340, 350, 360 from the antenna stations 310, 320, 330 to the vehicle 300 are different. By calculating the time it takes for a given signal to reach an antenna station and multiplying that result by the speed of light, a known physical constant, the distances 340, 350, 360 can be obtained.

Knowing the positions of the antenna stations 310, 320, 330 and knowing the distances 340, 350, 360 makes it possible to find loci of points 370, 380, 390 denoting the possible locations of the vehicle as determined from the point of view of each antenna station 310, 320, 330. These loci 370, 380, 390 are simply circles with radii equal to the distances 340, 350, 360 between the vehicle 300 and the antenna stations 310, 320, 330. Where all three loci 370, 380, 390 intersect is the location of the vehicle 300. The speed limit information to be reported to the driver can then be retrieved by looking up the location, and transmitted back to the cellular telephone or vehicle.

Of course, tracking the location of the vehicle 300 over time makes it possible to determine the speed of the vehicle. Thus, the cellular telephone-based tracking system can also be used to determine the speed of the vehicle. When the vehicle exceeds the posted speed limit, a warning chime can be played in the earpiece or speaker of the cellular telephone to warn the driver of traveling at an excessive speed.

Another modification that can be made is to have the vehicle 300 itself communicate with the antenna stations 310, 320, 330, rather than use a cellular telephone or a GPS receiver. Yet another possible variation would be to have the vehicle 300 or cellular telephone calculate the distances to transmitting antenna stations 310, 320, 330. The speed limit information can then either be looked up in a local database associated with the telephone or vehicle 300 or looked up at a remote database communicated with via radio.

Figure 4:
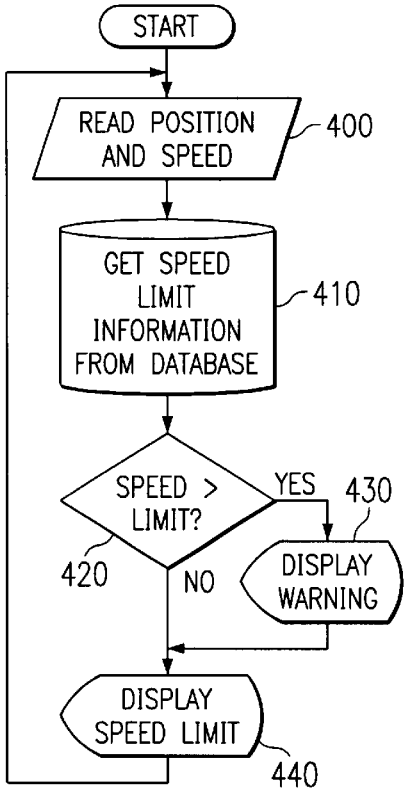
FIG. 4 is a flowchart representation of a GPS-based embodiment of the present invention utilizing a local database.

FIG. 4 is a flowchart representation of the operation of one embodiment of the invention. First a vehicle's position and speed are determined, either through a GPS receiver or through the use of cellular telephone signals as described above 400. Next, the position of the vehicle is used as a search key to look up, in a database, a speed limit associated with the location 410. If the vehicle's speed exceeds the posted speed limit 420, a warning is displayed to the driver 430. In any case, the posted speed limit is displayed to the driver 440. The process then repeats itself 400.

Figure 5:
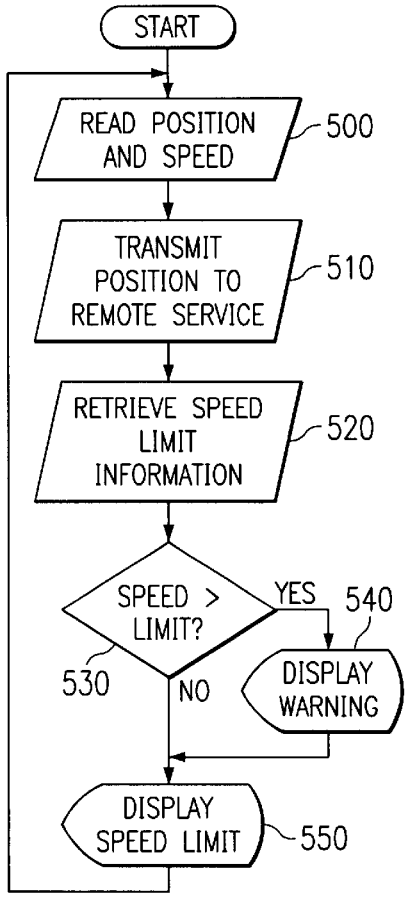
FIG. 5 is a flowchart representation of a GPS-based embodiment of the present invention utilizing a remote database.

FIG. 5 is a flowchart representation of the operation of an alternative embodiment of the invention. First a vehicle's position and speed are determined, either through a GPS receiver or through the use of cellular telephone signals as described above 500. Next, the position of the vehicle is transmitted to a remote database service 510, where it is used to look up, in a database, a speed limit associated with the location. The speed limit is then retrieved from the remote service 520. If the vehicle's speed exceeds the posted speed limit 530, a warning is displayed to the driver 540. In any case, the posted speed limit is displayed to the driver 550. The process then repeats itself 500.

Figure 6:
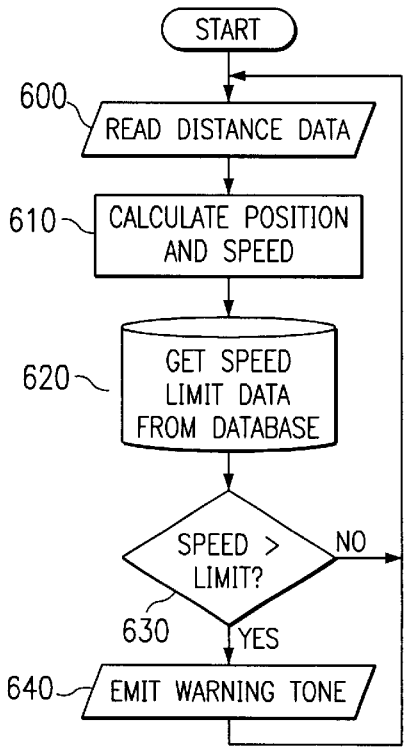
FIG. 6 is a flowchart representation of a cellular-telephone based embodiment of the present invention.

FIG. 6 is a flowchart representation of the operation of another alternative embodiment of the invention. First a vehicle or cellular telephone's distance to antenna stations in known locations is determined 600. Next, the vehicle's or telephone's position and speed are calculated based on the distance information 610. Next, the position of the vehicle or telephone is used to look up, in a database, a speed limit associated with the location 620. If the speed at which the vehicle of telephone is moving exceeds the posted speed limit 630, a warning tone is provided to the driver 640. The process then repeats itself 600.

One of ordinary skill in the art will appreciate that the invention herein disclosed may be applicable to the dissemination to a vehicle operator of various types of position-dependent information, including traffic notices, warning signs, and other information that needs to be transmitted to a vehicle operator. For instance, the present invention could be used to display to a driver on a turnpike the amount of toll at the next tollbooth.

One of ordinary skill in the art will also appreciate that the vehicle in question need not be an automobile or truck. Other vehicles can benefit from position-related information as well. Vehicles that might benefit from the technology herein disclosed also include (but are not limited to) rail vehicles, aircraft, and marine craft.

It is important to note that while the present invention has been described in the context of a fully functional data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media such a floppy disc, a hard disk drive, a RAM, and CD-ROMs and transmission-type media such as digital and analog communications links.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A method for conveying traffic notices to an operator of a vehicle, comprising the steps of:

determining a position of the vehicle;

using the position to retrieve, from a database, information about a traffic notice;

detecting whether the vehicle is being operated in a way that is in violation of the traffic notice; and in response to the vehicle being operated in a way that is in violation of the traffic notice, playing a warning sound in an earpiece of a mobile telephone associated with the operator.

2. The method of claim 1, wherein the determining step includes a step of retrieving the position of the vehicle from a Global Positioning System (GPS) receiver.

3. The method of claim 1, comprising the steps of:

detecting a speed of the vehicle;

comparing the speed with the traffic notice, wherein the traffic notice is a speed limit; and if the speed exceeds the speed limit, playing the warning sound in the earpiece of the mobile telephone.

4. The method of claim 1, wherein the warning sound is a warning chime.

5. The method of claim 1, wherein the determining step includes a step of calculating the position of the vehicle by triangulating mobile telephone signals.

6. The method of claim 1, wherein the presenting step includes a step of displaying the information.

7. A computer program product, in a computer-readable medium, for conveying traffic notices to an operator of a vehicle, comprising instructions for:

determining a position of the vehicle;

using the position to retrieve, from a database, information about a traffic notice; detecting whether the vehicle is being operated in a way that is a violation of the traffic notice; and in response to the vehicle being operated in a way that is in violation of the traffic notice, playing a warning sound in an earpiece of a mobile telephone associated with the operator.

8. The computer program product of claim 7, wherein the instructions for determining include instructions for retrieving the position of the vehicle from a Global Positioning System (GPS) receiver.

9. The computer program product of claim 7, comprising instructions for:

detecting a speed of the vehicle;

comparing the speed with the traffic notice, wherein the traffic notice is a speed limit; and if the speed exceeds the speed limit, playing the warning sound in the earpiece of the mobile telephone.

10. The computer program product of claim 7, wherein the warning sound is a warning chime.

11. The computer program product of claim 7, wherein the instructions for determining include instructions for calculating the position of the vehicle by triangulating mobile telephone signals.

12. The computer program product of claim 7, wherein the instructions for presenting include instructions for displaying the information.

13. A system for reporting speed limit inflation to an operator of a vehicle, comprising:

a GPS (Global Positioning System) receiver;

a database;

an output unit; and a data processing system in communication with the GPS receiver, database, and display unit, wherein the GPS receiver determines the location of the vehicle, the data processing system receives the location from the GPS receiver, the data processing system uses the location to retrieve speed limit information from the database, the data processing system determines a speed of the vehicle, and in response to the speed exceeding a speed limit denoted by the speed limit information the data processing system directs a mobile telephone to play a warning sound.

14. A system for warning an operator of a telephone mobile of an exceeded speed limit, comprising:

a plurality of receiving stations tuned to receive a signal from the mobile telephone;

a database; and a data processing system in communication with the plurality of receiving stations, the database, and the mobile telephone, wherein the data processing system compares arrival times of the signal from the plurality of receiving stations, the data processing system analyzes the receiving times to determine a location and speed of the cellular telephone, the data processing system uses the location to look up speed limit information in the database, and if the speed exceeds the speed limit, the data processing system generates a warning sound and plays the warning sound in an earpiece of the mobile telephone.

15. A system for reporting speed limit information to an operator of a vehicle having a mobile telephone, comprising:

a radio receiver;

a database; and a data processing system in communication with the first radio transceiver and database, wherein the radio receiver determines the location of the vehicle by triangulating signals from a plurality of known transmission stations, the data processing system receives the location from the radio receiver, the data processing system uses the location to retrieve speed limit information from the database, the data processing system compares a speed of the vehicle with the speed limit information, and if the vehicle is exceeding a posted speed limit, the data processing system notifies the operator by playing a warning sound in an earpiece of the mobile telephone.

* * * * *